US009714160B2

(12) United States Patent
Benz

(10) Patent No.: US 9,714,160 B2
(45) Date of Patent: Jul. 25, 2017

(54) LIFTING APPARATUS FOR LIFTING AND LOWERING VEHICLES, LOADS OR THE LIKE

(71) Applicant: Gerhard Finkbeiner, Freudenstadt (DE)

(72) Inventor: Dieter Benz, Alpirsbach (DE)

(73) Assignee: Gerhard Finkbeiner, Freudenstadt (DE)

( * ) Notice: Subject to any disclaimer, the term of this patent is extended or adjusted under 35 U.S.C. 154(b) by 0 days.

(21) Appl. No.: 14/896,029

(22) PCT Filed: Jun. 27, 2014

(86) PCT No.: PCT/EP2014/063734
§ 371 (c)(1),
(2) Date: Dec. 4, 2015

(87) PCT Pub. No.: WO2014/207218
PCT Pub. Date: Dec. 31, 2014

(65) Prior Publication Data

US 2016/0122168 A1 May 5, 2016

(30) Foreign Application Priority Data

Jun. 27, 2013 (DE) ..... 20 2013 102 803 U

(51) Int. Cl.
*B66F 3/44* (2006.01)
*B66F 13/00* (2006.01)
(Continued)

(52) U.S. Cl.
CPC ..... *B66F 13/00* (2013.01); *B66F 3/02* (2013.01); *B66F 3/46* (2013.01); *B66F 7/025* (2013.01); *B66F 7/04* (2013.01); *B66F 7/28* (2013.01)

(58) Field of Classification Search
CPC ..... B66F 3/14; B66F 3/20; B66F 5/02
See application file for complete search history.

(56) References Cited

U.S. PATENT DOCUMENTS 4,679,660 A 7/1987 Suzuki
4,715,477 A 12/1987 Suzuki
(Continued)

FOREIGN PATENT DOCUMENTS

CH 648 268 A5 3/1985
DE 76 19 866 U 11/1976
(Continued)

OTHER PUBLICATIONS

International Search Report for corresponding Patent Application No. PCT/EP2014/063734 dated Sep. 10, 2014.

*Primary Examiner* — Lee D Wilson
(74) *Attorney, Agent, or Firm* — Renner, Otto, Boisselle & Sklar, LLP

(57) ABSTRACT

A lifting apparatus for lifting and lowering vehicles or the like, including a support which is movable up and down and on which a load receiver is provided, the load receiver having at least one supporting arm. An articulated connection is formed between the supporting arm and an add-on part and once the add-on part is oriented in an angular position with respect to the supporting arm, the add-on part and the supporting arm are mountable and fixable with respect to each other by a toothed element, a blocking element and a lock pin.

15 Claims, 5 Drawing Sheets

Figure 1:
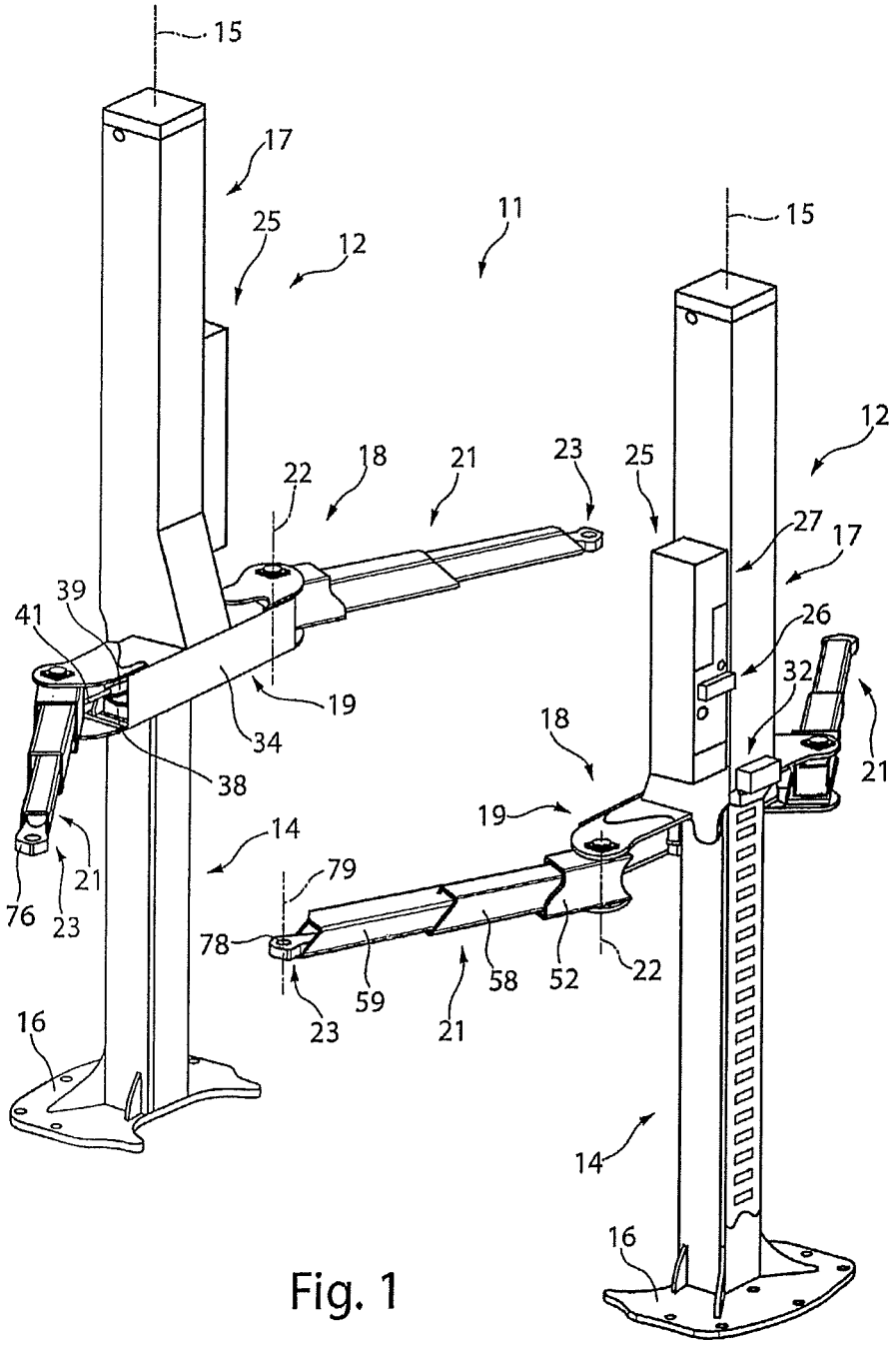

(51) Int. Cl.

| | |
|---|---|
| ***B66F 7/02*** | (2006.01) |
| ***B66F 7/04*** | (2006.01) |
| ***B66F 7/28*** | (2006.01) |
| ***B66F 3/46*** | (2006.01) |
| ***B66F 3/02*** | (2006.01) |

(56) References Cited

U.S. PATENT DOCUMENTS

| | | | | |
|---|---|---|---|---|
| 4,825,977 | A * | 5/1989 | Isogai | B66F 7/02 187/203 |
| 5,009,287 | A * | 4/1991 | Starr | B66F 7/04 187/213 |
| 6,485,001 | B1 * | 11/2002 | Mallery | B66C 23/48 254/124 |
| 7,150,073 | B2 * | 12/2006 | Stewart | E05D 11/1007 16/354 |
| 8,256,577 | B2 * | 9/2012 | Kritzer | B66F 3/46 187/215 |
| 8,596,627 | B2 * | 12/2013 | Lands | B25H 1/0007 254/2 B |
| 9,150,395 | B2 * | 10/2015 | Kritzer | B66F 7/20 |
| 2016/0052757 | A1 * | 2/2016 | De Jong | B66F 3/24 254/89 H |
| 2016/0122168 | A1 * | 5/2016 | Benz | B66F 7/025 254/133 R |
| 2016/0152454 | A1 * | 6/2016 | Stapensea | B66F 3/46 700/213 |

FOREIGN PATENT DOCUMENTS

| | | | |
|---|---|---|---|
| DE | 25 47 122 | A1 | 5/1977 |
| DE | 27 42 518 | A1 | 3/1979 |
| DE | 30 26 160 | A1 | 2/1982 |
| DE | 691 07 560 | T2 | 6/1995 |
| DE | 10 2007 020041 | A1 | 10/2008 |
| EP | 0478035 | A1 | 4/1992 |
| FR | 2 302 272 | A1 | 9/1976 |
| FR | 2356343 | A7 | 1/1978 |
| TW | 537 983 | B | 6/2003 |

* cited by examiner

LIFTING APPARATUS FOR LIFTING AND LOWERING VEHICLES, LOADS OR THE LIKE

The invention relates to a lifting device for lifting and lowering loads, vehicles or similar, having a support which is able to move up and down, on which a load receiving means is provided, wherein the load receiving means comprises at least one support arm or a mounting part.

A two-column lifting platform is known from DE 691 07 560 T2 which consists of two lifting columns and supports which are able to move up and down on the lifting columns. Two jointed arms are provided as pivotable support arms on each support, which are pivotable and able to be positioned with respect to the loading receiving points located there with the loading receiving element thereof underneath a vehicle to be lifted. To secure the adjusted position of the support arms with respect to the support, a locking device is provided which is unlocked in the case of a lowered support, such that the support arms are able to pivot freely. Directly after the beginning of a lifting movement of the support, the adjusted positions of the support arms with respect to the support are fixed by the locking device, such that the adjusted support arm position is maintained with respect to the vehicle. The locking device comprises a truncated cone-shaped gear wheel, on which a truncated cone-shaped sprocket, formed in a complementary manner, is able to be set for the non-rotatable fixing of the support arm. A pivot connection is formed between the support arm and the support which does not enable a disassembly and an exchange of the support arm with respect to the support. Rather, a permanent connection is provided by the constructive arrangement.

The present invention provides a lifting device for lifting and lowering vehicles, loads or similar which enables a simple and quick mounting as well as a fixing of a mounting part on the support or of the support arm as well as a simple adjustment of an angular position of the mounting part with respect to the support arm or support.

More particularly, there is provided a lifting device for lifting and lowering vehicles, loads or similar having a support which is movable up and down, on which a load receiving means is provided, wherein the load receiving means has at least one support or support arm, wherein a jointed connection is formed between the support or the support arm and a mounting part, in the case of which a positive locking of the mounting part with respect to the support or support arm is formed to maintain the angular position after the alignment of the mounting part with respect to the support or support arm in an angular position with respect to each other and a subsequent positioning of a respective longitudinal axis of at least one bore on the support or support arm with a longitudinal axis of at least one bore on the mounting part, and the support or the support arm and the mounting part are fixed with respect to each other by a cotter pin which is insertable into the bores, or in the case of which, after a positioning of a respective longitudinal axis of at least one bore of the support or of the support arm and of a longitudinal axis of at least one bore with respect to the mounting part with respect to each other, these are mounted rotatably with respect to each other by inserting a cotter pin and the mounting part and the support or the support arm are traversable relative to each other along this longitudinal axis, wherein the mounting part is freely pivotable with respect to the support or the support arm in an adjustment position and a positive locking is formed in a working position after an axial traversing movement between the mounting part and the support or support arm, due to which the adjusted angular position of the mounting part is fixed with respect to the support or support.

According to a first embodiment of the lifting device according to the invention, it is provided that a jointed connection is formed between the support and a mounting part or between the support arm and a mounting part, in which, after the alignment of the mounting part with respect to the support or support arm in an angular position with respect to each other and a subsequent positioning or a respective longitudinal axis of at least one bore on the support or support arm and a longitudinal axis of at least one bore of the mounting part, a positive locking of the mounting part with respect to the support or support arm is formed to maintain the angular position and the support and the mounting part or the support arm and the mounting part are fixed to each other by a cotter pin which is able to be inserted into the bores. This arrangement enables a simple handling both to exchange different mounting parts on the support or the support arm and an adaptation of an angular position of the mounting part with respect to the support or support arm for a subsequent lifting and lowering, in particular of vehicles. Due to the positive locking of the mounting part with respect to the support or support arm, an additional locking of the pivot arrangement is not necessary. Rather, at the same time, a securing of this angular position can be achieved with the positioning of the mounting part with respect to the support arm or support. Due to the simple insertion of a cotter pin for the formation of the jointed connection and simultaneous positive locking, a simple handling as well as an exchange or an adaptation in the angular position of the mounting part with respect to the support or support arm is enabled. Robust mechanics are thereby enabled which withstand rough workshop operations.

An alternative embodiment of the invention provides that, after the positioning of a respective longitudinal axis of at least one bore of the support or support arm and of at least one bore of the mounting part, these are mounted rotatably with respect to each other by insertion of a cotter pin and the mounting part and the support or the support arm are traversable relative to each other along a longitudinal axis of the cotter pin, wherein the mounting part is freely pivotable in an adjustment position of the mounting part with respect to the support or support arm, and a positive locking is formed in a work position after an axial traversing movement between the mounting part and the support or support arm, and an adjusted angular position of the mounting part with respect to the support or support arm is fixed. In this embodiment according to the invention, a handling according to the first described embodiment can occur. Alternatively it can also be provided that, firstly, the jointed connection is produced, whereupon, subsequently, a relative traversing movement between the mounting part and the support or support arm occurs for the formation of the positive locking at the subsequently adjusted angular position which is secured by the positive locking. For example, in this embodiment it can be provided that, by manual lifting of the mounting part with respect to the support or support arm, an adjustment of the angular position of the mounting part with respect to the support or support arm occurs and, by a subsequent lowering of the mounting part due to gravity, the positive locking is assumed. This enables an even simpler handling for the adjustment of the angular position of the mounting part with respect to the support or support arm, without the cotter pin having to be removed from the jointed connection. This embodiment has the advantage that, to change the angular position, only the securing element of the pivot arrangement must be removed in order to release the positive locking by changing the position of the mounting part in the vertical direction in order to subsequently set a new angular position of the mounting part by a rotational movement around a vertical longitudinal axis of the cotter pin. Subsequently, for example, a positive locking and subsequently an insertion of the securing element to maintain the positive locking can occur, for example due to a lowering movement of the mounting part or a lifting movement of the support or of the support arm.

In the first embodiment of the positive locking, the blocking element has a retaining section, in particular a bracket-shaped retaining section, on which the at least one gear or the at least one pin element is moulded, preferably in one piece. The blocking element can therefore advantageously be formed as a simple punched or laser-cut part which is able to be fixed on the support or support arm or the mounting part in a simple manner by means of the retaining section, for example by clamping or pressing.

The toothing element of the positive locking advantageously extends, according to a first embodiment, along an angular range for an adjustable angular positioning of the mounting part with respect to the support or support arm, wherein a curved segment having a toothing is provided along the angular range. Here, the toothing element can also have two or more intermediate spaces for positioning the blocking element. For example, two to five intermediate spaces can be sufficient, which extend advantageously at an angular range of at least 10° to a maximum of 180°.

The toothing element of the first embodiment of the positive locking is preferably formed to be plate-shaped and has a bore adjacent to the toothing, through which the cotter pin is able to be guided. An additional centring of the toothing element with respect to the longitudinal axis of the cotter pin or the pivot arrangement can thereby occur. Additionally, a fastening section can be provided opposite the toothing element in order to fix the toothing element to the support or support arm, in particular load receiving element of the support or support arm.

According to an alternative embodiment of the invention, it is provided that the positive locking is formed on a load receiving element of the support or support arm by two or more front surfaces arranged at an angle with respect to each other, said positive locking positively striking the mounting part on at least one contact surface or contact surfaces formed in a complementary manner. Therefore, alternatively to an additional blocking and toothing element, the load receiving element itself can be used as well as the mounting part for a positive locking. The front surfaces on the support or support arm and mounting part are preferably aligned in a parallel plane with respect to the longitudinal axis of the bore or the cotter pin and are arranged radially relative to the longitudinal axis of the bore in the load receiving element.

A further alternative embodiment for a positive locking between the mounting part and the support or support arm is provided by the at least one bore on the support or support arm as well as on the mounting part having an inner toothing and the cotter pin being provided with an outer toothing and a positive locking being formed during insertion of the cotter pin into the at least one bore of the support or support arm and of the mounting part. Therefore, the use of an additional toothing element and blocking element is dispensable, since the gear or pin elements are provided directly on the outer periphery of the cotter pin as well as on the inner periphery of the at least one bore on the support or support arm and mounting part.

A further advantageous embodiment of the alternative embodiment according to the invention provides that the mounting part has a fork-shaped connection piece and the support or the support arm has a plate-shaped load receiving element each having a bore for the cotter pin. Defined connection points can thereby be created and various and different mounting parts can be arranged on the support or support arm.

A preferred embodiment provides that the fork-shaped connection piece has an intermediate space which comprises at least the thickness of the load receiving element and comprises the thickness of a locking element or blocking element. Therefore, according to the first embodiment according to the invention, a simple guiding of the load receiving element of the support arm or support into itself with respect to the mounting part can occur. Furthermore, it can preferably be provided that the fork-shaped connection piece has an intermediate space which comprises at least the thickness of the load receiving element and at least double the thickness of a toothing or blocking element. A relative movement between the load receiving element and the fork-shaped connection piece is thereby possible, due to which the positive locking can be released without the cotter pin having to be removed from the connection piece of the mounting part and of the support or support arm. Therefore, for example, in the case of a lowered load receiver, for the adjustment of the angular position of the mounting part with respect to the support or support arm, the mounting part can be manually lifted in order to subsequently pivot into the desired position and to occupy the positive locking automatically again due to a subsequent lowering of the mounting part.

Furthermore, it can preferably be provided that a releasable securing element which strikes the cotter pin secures the work position of the mounting part with respect to the support or support arm. Due to the introduction of the securing element in the remaining intermediate space during occupation of the positive locking between the load receiving element of the support arm or the support and the connection piece, the adjusted angular position can be secured such that a pivot movement of the mounting part with respect to the support or support arm is not enabled without removing the securing element.

Subsequently, a free pivot movement of the mounting part with respect to the support arm or support is possible, wherein the thickness of the securing element corresponds to the thickness of the blocking elements and the toothing element in order to ensure a complete disengagement of the blocking element from the toothing elements after the removal of the securing element.

Furthermore, it is preferably provided that the securing element is formed as a releasable fastening means which is able to be arranged on or in the cotter pin or the cotter pin is able to be inserted into the fastening element. The securing element can preferably be able to be arranged between the plate-shaped load receiving element and the fork-shaped connection piece. A compact and secure arrangement can thereby be created.

According to a preferred embodiment of the invention, it is provided that the cotter pin is able to be inserted from above after the positioning of the mounting part with respect to the support arm or the support and forms a jointed connection. This also enables an additional securing of the pin to be able to be omitted as, in particular under a load acting on the mounting part, the pin is not able to be taken out.

Figure 2:
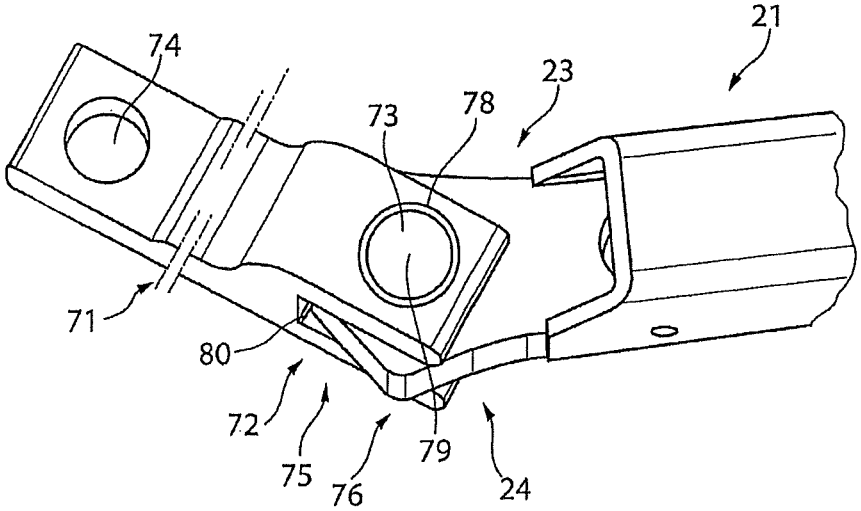
Figure 3:
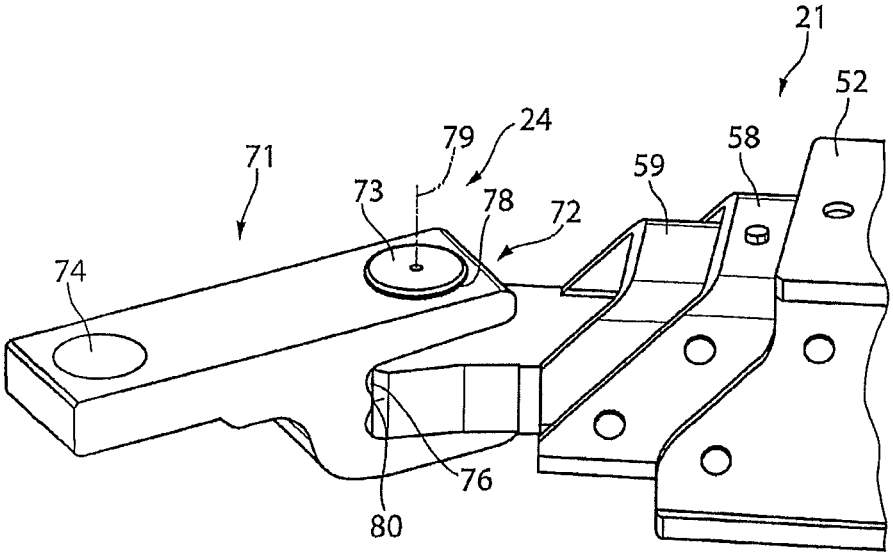
Figure 4:
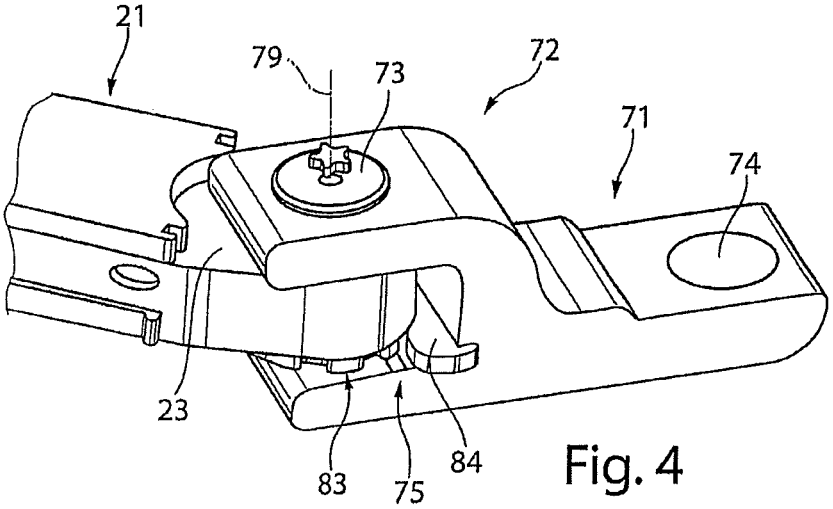
Figure 6:
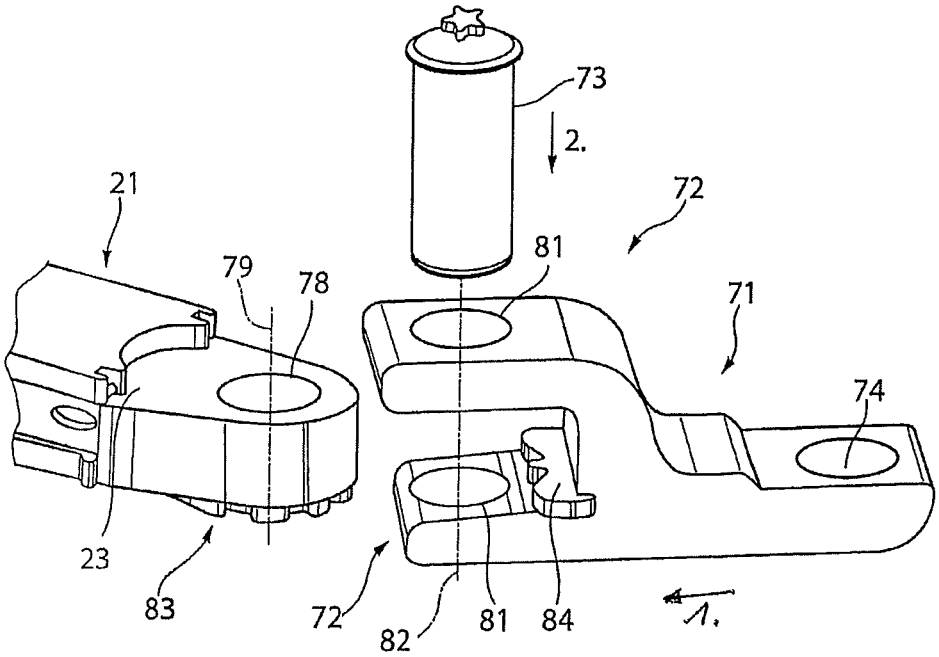
Figure 5:
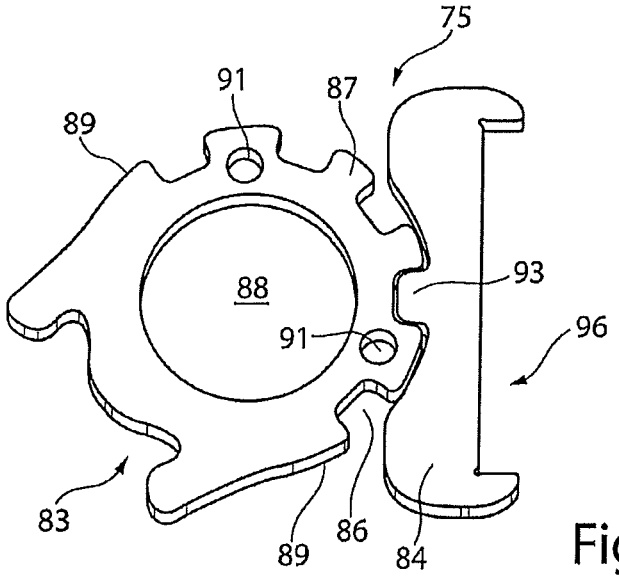
Figure 7:
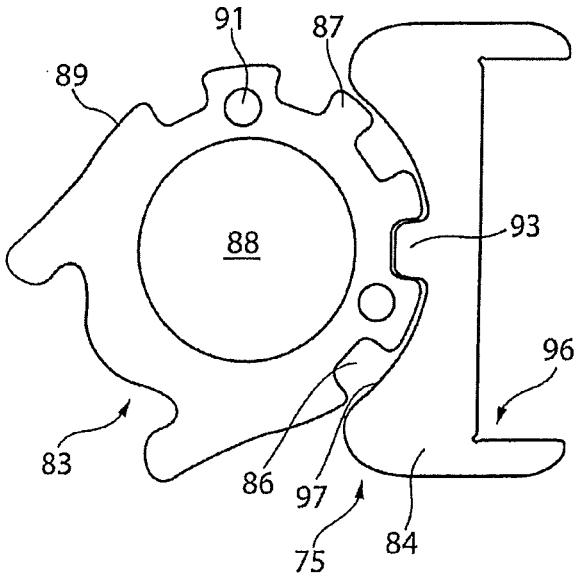
Figure 8:
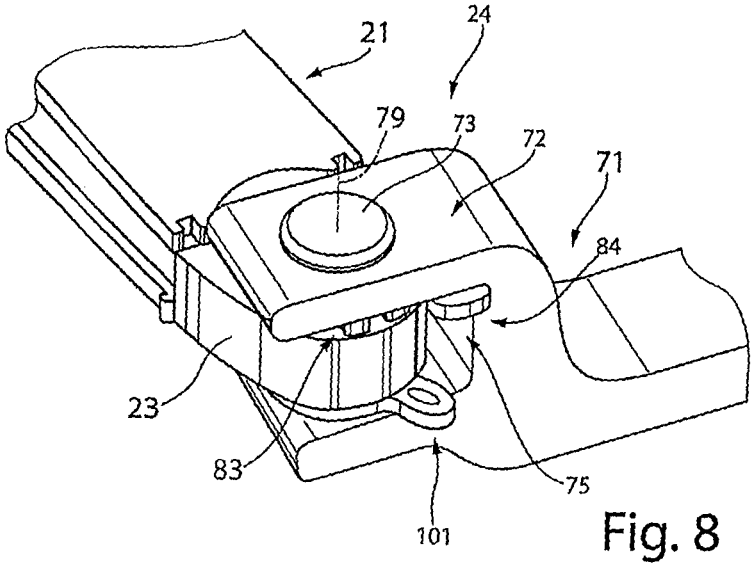
Figure 9:
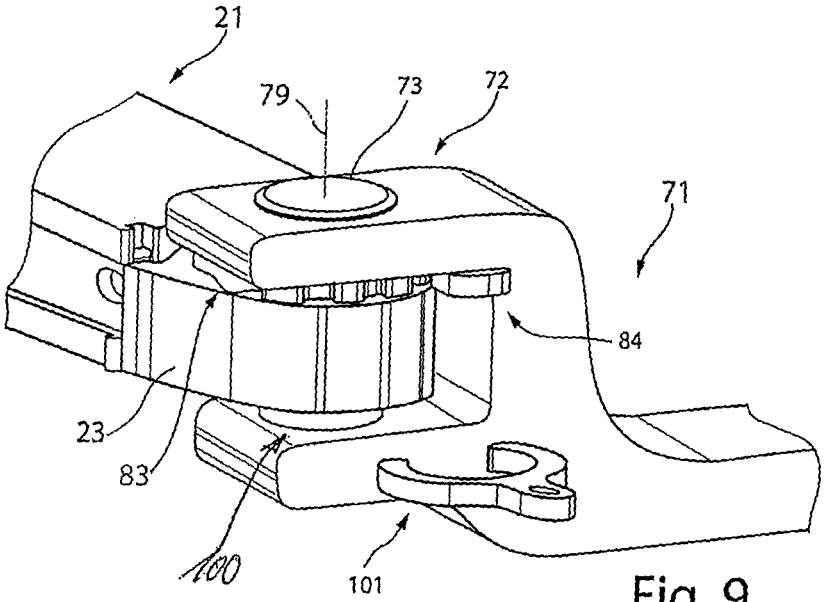

The invention as well as further advantageous embodiments and developments of the same are described and explained in more detail below by means of the examples depicted in the drawings. The features to be gleaned from the description and the drawings can be applied individually or together in any combination according to the invention. Here are shown:

FIG. 1 a perspective view of a lifting device forming a two-column lifting platform, FIG. 2 a perspective view of a mounting part on a support arm, FIG. 3 a perspective view of an alternative embodiment of a mounting part on a support arm to FIG. 2, FIG. 4 a perspective view of a further alternative embodiment of a mounting part on a support arm to FIG. 2, FIG. 5, a schematic view onto a positive locking for positioning of the angular position between the mounting part and the support arm in FIG. 4, FIG. 6 a perspective exploded depiction with respect to a description of an assembly of a mounting part on a support arm according to one embodiment in FIG. 4, FIG. 7 a schematic view onto an alternative embodiment of the a positive locking to FIG. 5, FIG. 8 a perspective view of an alternative embodiment of a jointed connection to FIG. 5 and FIG. 9 a further perspective view of the alternative embodiment according to FIG. 8

In FIG. 1, a two-column lifting platform 11 is depicted perspectively, by way of example, which comprises two lifting devices 12 which are allocated to each other. This lifting device 12 comprises a lifting column 14 which, for example, is connected to a base plate 16 firmly, which is connected fixedly to the ground. A support 17 is provided to be able to move up and down along a lifting axis 15 of the lifting device 11. The support 17 receives a load receiving means 18. The load receiving means 18 comprises a housing section 19 which is closed at least partially, on the respective outer ends of which support arms 21 are received to be pivotable around a vertical pivot axis 22. These support arms 21 are, for example, formed to be telescopic and have load receiving elements 23 or provisions which lie opposite the pivot axis 22 in order to arrange different support elements or also mounting parts 71 (see FIG. 2 et seq.) exchangeably thereon.

The support 17 furthermore receives a drive device 25. This can be formed to be electrohydraulic, hydraulic or mechanical and has a hydraulic unit according to the depicted embodiment. This drive device 25 is monitored and controlled by a control 26. At least one accumulator 27, for example, can be provided for the energy supply. The control 26 advantageously works wirelessly. In particular, a remote control can be provided in order to control the lifting devices 12. In particular, the two lifting devices 12 which are allocated to each other and lie opposite each other also communicate wirelessly with each other in order to ensure, for example, a simultaneous initiation of a lifting and lowering movement as well as a mutual monitoring of synchronisation or similar. Alternatively, supply lines and/or control lines can be provided between the two lifting devices 12, such that both control signals and a current supply are enabled via cable.

The support 17 is formed to be sleeve- or cartridge-shaped and encloses the lifting column 14. In this arrangement, it is therefore provided that the drive spindle or the hydraulic cylinder for lifting and lowering the support 17 is arranged within the lifting column 14. The hydraulic cylinder is supported on one side on a lower end of the lifting column 14 or the base plate 16 and strikes the upper, inner end section of the support 17. To guide the support 17 with respect to the lifting column 14, guide elements 29 lying therebetween are provided which, for example, can be formed as roller or sliding elements or as a combination thereof. Furthermore, a drop guard 32 is provided between the lifting column 14 and the support 17, with which a deactivation or a current shutdown of a holding magnet of the drop guard occurs after controlling a lifting movement of the support 17 and a locking element implements a securing of the adjusted lifting position.

An alternative embodiment of the lifting device 12 provides that the lifting columns have a U-shaped cross-section, within which the support is guided to be able to move up and down, wherein the at least partially closed housing section 19, analogously to the lifting device 12 according to FIG. 2, is arranged on the support 17 in order to receive the support arms 21.

In this depicted embodiment, the support arm 21 is formed, for example, as an extendable support arm and consists of at least one support arm piece 58 which is able to be inserted into a support arm body 52 and is mounted to be displaceable therein. This support arm body 52 has a box-shaped housing in the form of a square. The loading receiving element 23 is arranged on the support arm piece 58 or, as is depicted by way of example in the exemplary embodiment in FIG. 1, on the second support arm piece 59.

In FIG. 2, a perspective view of the support arm 21 having a load receiving element 23 arranged thereon is depicted, to which a mounting part 71, for example in the form of an extension of the support arm 21 is attached. This mounting part 71 has a U-shaped or fork-shaped receiving section 72 which encloses the load receiving element 23 which is preferably formed to be plate-shaped. The load receiving element 23 has front surfaces 76 on the free end thereof, which are aligned in parallel to the longitudinal axis 79 of a bore 87 in the load receiving element 23 (FIG. 1). For example, two V-shaped front surfaces 76 which are aligned with respect to each other are provided in order to be able to receive the mounting part 71 in two predetermined angular positions. At least one contact surface 80 is formed in the base of the U-shaped receiving section 72 which abuts onto at least one of the front surfaces 76 and a positive locking 75 with regard to the angular position of the mounting part 71 with respect the support arm 21 is provided after the introduction of a cotter pin 73 into bores 81 of the receiving section 72 and of the bore 78. The alignment of the mounting part 71 occurs depending on the angularity of the front surfaces 76 arranged with respect to each other, whereby the alignment thereof with respect to the support 17 is influenced in the lifting column 14.

Alternatively, instead of only two front surfaces 76, several front surfaces 76 can also be provided which are aligned at a predetermined angle with respect to each other. Advantageously, the arrangement in rows one on the other of the front surfaces 76 occurs at the same angle such that each front surface 76 strikes the contact surface(s) 80 according to the angular position on the contact surface 80 and the positive locking 75 is formed.

Due to this arrangement, a simple exchange of the mounting part with respect to the support arm 21 is enabled as well as a simple alignment in the angular position of the mounting part 71 with respect to the support arm 21. Simply an insertion of the cotter pin 73 is sufficient for the connection of the mounting part 71 with respect to the support arm 21 for the formation of the jointed connection 24 and maintenance of the positive locking 75.

The embodiment described above applies analogously to the connection of the mounting part 71 directly to the support 17. Such an embodiment is, for example, then provided if the mounting part 71 serves as a retainer or receiver for a wheel gripper element or a wheel support element or, in the case of two mounting parts 71 which are arranged on the support at a distance with respect to each other, to receive a guide rail. Furthermore, it can be provided that in the case of a lifting device consisting of four lifting columns 14, each two adjacent lifting columns 14 are connected to a guide rail, wherein the guide rails are received by mounting parts 71 on the support 17 or on the support arm 21 and the width of the lane is adjustable using the distance of the guide rails or of the lifting columns 14 which each lie opposite one another or using telescopic support arms 21.

The mounting part 71 according to FIG. 2 can furthermore have a bore 74 which is at a distance to the bore 78 in order, for example, to insert rubber supports or another load receiving means which are provided for positioning on load receiving points of a vehicle.

In FIG. 3, an alternative embodiment to FIG. 2 is depicted. This embodiment deviates from FIG. 2 to the effect that the U-shaped receiving section 72 of the mounting part 71 is positioned to be rotated by 180° on the load receiving element 23. In this embodiment in FIG. 3, in addition to the embodiment depicted in FIG. 2, for example, a telescopic support arm 21 is depicted in a retracted position in which, for example, the first support arm piece 58 is retracted in the support arm body 52 and the second support arm piece 59 is retracted in the first support arm piece 58. Alternatively, the load receiving element 23 can be arranged directly on the support arm body 52, both in the case of the embodiment according to FIG. 2 and in the case of the embodiment according to FIG. 3, which is provided, for example, to be pivotable on the support 17 or can be provided directly on the support 17, wherein the load receiving element 23 is then preferably arranged firmly on the support 17.

In FIG. 4 an alternative embodiment of a mounting part 71 for the positioning and fixing of an angular position with respect to the support arm 21 is depicted. In this embodiment, the positive locking 75 is formed differently from the embodiment according to FIG. 2 and FIG. 3. This positive locking 75 comprises, for the positioning of the mounting part 71 in an angular position with respect to the support arm 21, a toothing element 83 which interacts with a blocking element 84. The toothing element 83 is, for example, positioned on an upper or lower side of the load receiving element 23. The blocking element 84 engages, for example, with the U-shaped receiving section 72 and is fastened thereto. A view onto the toothing element 83 and blocking element 84 is depicted in more detail, and in an isolated manner in FIG. 5. The toothing element 83 is preferably formed to be plate-shaped and has a toothing 83 along an angular range for an adjustable angular position, which preferably comprises intermediate spaces 86 arranged at regular intervals which are formed by teeth 87. Adjacent to the toothing 85, a bore 88 is formed which corresponds in diameter to that of the cotter pin 73 or the bore 78 of the loading receiving element 23. The toothing 85 extends over a curved segment of at least 10° to preferably 180°. Stop surfaces 89 are subsequently formed on each of the ends thereof which limit the rotational position of the mounting part 71 with respect to the support arm 21.

In the case of only one pin element 93 on the blocking element 84, the toothing 85 on the toothing element 83 can also be irregular.

Furthermore, for example, two fixing bores 91 are depicted, through which the toothing element 83 is able to be fixed, for example, with respect to an upper or lower side of the load receiving element 23.

The blocking element 84 preferably has a gear or a pin element 93 which is provided for the positive engagement in one of the intermediate spaces 86. Support surfaces 94 extend adjacent to the gear element 93, said support surfaces advantageously abutting onto front surfaces of the teeth 87 forming the intermediate space 86 in order to form an enlarged contact and support surface to secure the angular position of the mounting part 71 with respect to the support arm 21. Furthermore, a retaining section 96 is provided on the blocking element 84 which is preferably formed to be bracket-shaped, as is depicted in FIG. 5, which is able to be positioned according to FIG. 4 on the base of the U-shaped receiving section 72 and is preferably able to be fixed by pressing.

FIG. 6 shows a schematic exploded depiction for the clarification of a connection of the mounting part 71 to the support arm 21. Firstly, the mounting part 71 is aligned in a predetermined angular position with respect to the support arm 21. Subsequently, the mounting part 71 is positioned with respect to the support arm 21 such that the mounting part 71 is fixed in the angular position by the positive locking 75. Subsequently, the cotter pin 73 is advantageously inserted from above into the bores 81 and the bore 78 in order to secure the positive locking 75 and to fix the mounting part 71 with respect to the support arm 21.

Preferably it is provided that a fork-shaped receiving section 72 is formed on the mounting part 71 and the load receiving element 23 is formed to be plate-shaped such that these are able to be inserted between the fork-shaped ends of the receiving sections 72. The distance of the fork-shaped ends or tabs of the receiving section 72 corresponds at least to the thickness of the plate-shaped load receiving element 23 as well as to the thickness of the toothing element 83 such that a simple inserting into each other is enabled. Advantageously, the toothing element 83 does not extend over the outer periphery of the load receiving element 23 which is arranged in the U-shaped receiving section 72, with regard to the teeth 87 and the intermediate spaces 86, such that an outer side of the load receiving element 23 is supported on a side surface of the pin element 93 in the case of formation of the positive locking 75 and therefore an unintentional release by an axial movement along the longitudinal axis 79 is prevented.

In FIG. 7, an alternative embodiment of the positive locking 75 is depicted to FIG. 5. This differs by further support surfaces 97 being formed on the blocking element 84 adjacent to the pin element 93 which follow the radius of the teeth 87 in order to form an enlarged support. Additionally, due to the enlargement of the support surface 97, a restriction in the angular range for the positioning of the mounting part 71 with respect to the support arm 21 can occur.

In FIGS. 8 and 9, an alternative embodiment of a jointed connection between a mounting part 21 and a support arm 23 to FIG. 4 is depicted perspectively.

This embodiment corresponds in construction and with regard to the components to the embodiment according to FIG. 4, wherein, in deviation from the embodiment according to FIG. 4, the toothing element 83 is provided, instead of on a lower side of the load receiving element 23, on an upper side of the load receiving element 23 and correspondingly opposite also the blocking element 84 on the mounting part 71. A clearance 100 is formed between a lower side of the load receiving element 23 and a tab of the receiving section 72. This clearance 100 comprises at least the thickness of the toothing element 83 such that during lifting of the mounting part 71 upwards, the pin element 93 of the blocking element 84 is released from the intermediate space 86 of the toothing element 83 such that the mounting part 71 is pivotable around the axis 79 and a new angular position with respect to the support arm 21 or support is adjustable. Due to a subsequent lowering of the mounting part 71 due to gravity, the positive locking 75 can be created by the pin element 93 in turn engaging with an intermediate space 96. The retaining element 101 depicted in FIGS. 8 and 9 can additionally still be introduced, as will be described below in more detail, however this is not necessary for the embodiment described above. It is only required that the clearance 100 is designed in size in such a way that the blocking element 84 is released with respect to the toothing element 83 or vice versa. This embodiment has the advantage over the embodiment described above in FIG. 4 that a complete release of the cotter pin 73 from the bores 81 and 78 is not required to change the angular position of the mounting part 71 with respect to the support arm 21. Rather the removal of the securing element 101 and a relative movement of the mounting part 71 along the longitudinal axis 78 and of the load receiving element 23 is sufficient to release the positive locking 75. Alternatively, in this embodiment, the cotter pin 73 can be extracted completely from the bores 81 and 78.

If the embodiment described above is to be secured against an unintentional change of the adjusted angular position, the securing element 101 can be used which, for example, fills the clearance 100, such that a relative movement between the mounting part 71 and the support arm 21, in particular of the connection piece 72, is blocked with respect to the load receiving element 23.

The securing element 101 can, for example, be formed as a completely closed ring or as an open ring or similar. According to a first embodiment it is provided that the circlip 101 is then releasable from the cotter pin 73 as soon as the cotter pin 73 is moved upwards at least partially along the longitudinal axis 79 such that a peripheral surface of the cotter pin 73 is guided out with respect to the securing element 101 such that the securing element 101 can be freely removed from the intermediate space between the tabs of the connection piece 72. Subsequently, the cotter pin 73 is lowered again such that subsequently the load receiving element 23 and the mounting part 71 are traversable relative to each other along the longitudinal axis 79 or 82.

An alternative embodiment can provide that the securing element 101, in the case of an inserted cotter pin 73, is able to be inserted from outside into the intermediate space or clearance 100 or attached from outside to the cotter pin 73 or is able to be inserted into the cotter pin 73 in order to block a relative traversing movement between the load receiving element 23 and the mounting 71.

To connect the mounting part 71 to the support arm 21, in this embodiment it can also be provided that the mounting part 71 is aligned in the angular position with respect to the support arm 21 and then the bores 81 of the mounting part 71 are aligned to the bore 78 of the load receiving element 23, wherein during alignment, the positive locking 75 is formed. Subsequently, the cotter pin 73 is inserted, in particular from above and if desired, the securing element 101 is inserted into the clearance 100, and the cotter pin 73 is guided through the securing element 101 and introduced into the lower bore 81. Alternatively it can also be provided that the bores 81 of the mounting part 71 are aligned to the bore 79 without a positive locking 75 being formed. Subsequently, the cotter pin 73 is inserted. Subsequently, if desired, a relative movement between the mounting part 71 and the support arm 21 occurs for the formation of the positive locking 75 in order to subsequently introduce the securing element 101, wherein the cotter pin 73 is moved upwards again partially, in order to position the securing element 101 to guide the cotter pin 73 through or the securing element 101 is attached to or set on or inserted into the cotter pin 73.

The exemplary embodiments described above by means of the arrangement of a mounting part 71 on a support arm 21 apply analogously for the connection of a mounting part 71 to the support 17. Furthermore it is understood that the fork-shaped receiving section 72 can be provided on the support arm 21 or support 17 instead of on the mounting part 71, and the load receiving element 23 is provided on the mounting part 71.

The mounting part 71 serves for load receiving and strikes the load or the vehicle or similar. This mounting part 71 can be a support arm which is connected to the support. It can be an extension which, for example, can be equipped on the free end with a rubber plate or similar. It can be a wheel receiving plate or a wheel fork or a wheel gripper.

All features and embodiments described above are significant to the invention in themselves and can be combined in any combination.

The invention claimed is:

1. A lifting device for lifting and lowering vehicles, loads or similar, comprising a support which is movable up and down, a load receiver provided on the support, wherein the load receiver has at least one support or support arm, the support or support arm having a load receiving element, the load receiving element having a bore, a mounting part having a bore, and a pin receivable in the bore in the load receiving element and the bore in the mounting part for forming a jointed connection between the load receiving element and the mounting part, wherein the load receiving element has at least one abutment surface fixed in relation thereto, and the mounting part has a U-shaped receiving section and said mounting part has at least one abutment surface fixed in relation thereto within the receiving section that is configured to interfere with the at least one abutment surface of the load receiving element to preclude rotation of the mounting element relative to the load receiving element at either one of at least two relatively rotated positions when the pin is received in the bore in the load receiving element and the bore in the mounting part to form the jointed connection.

2. The lifting device according to claim 1, wherein the at least one abutment surface on one of the load receiving element and mounting part has a plurality of teeth forming intermediate spaces therebetween, and the at least one abutment surface on the other of the load receiving element and mounting part has at least one pin element configured to be received selectively in a respective one of the intermediate spaces for locking the mounting part against rotation relative to the load receiving element in either one of the at least two relatively rotated positions.

3. The lifting device according to claim 2, wherein the the at least one pin element is unitary with the other of the load receiving element and mounting part.

4. The lifting device according to claim 2, wherein the plurality of teeth are formed on a toothing element that has a curved segment having the teeth and intermediate spaces arranged therebetween along an angular range for an adjustable angular position of the mounting part with respect to the support or support arm.

5. The lifting device according to claim 2, wherein the toothing element is plate-shaped and has formed therein adjacent to the toothing element one of said bores that receives the pin.

6. The lifting device according to claim 1, wherein the the at least one abutment surface on one of the load receiving element and mounting part includes two or more front surfaces which are arranged at an angle to each other and the at least one abutment surface on the other of the load receiving element and mounting part includes at least one contact surface that engages a respective front surface in adjustable angular positions for locking the mounting part against rotation relative to the load receiving element in either one of at the least two relatively rotated positions.

7. The lifting device according to claim 1, wherein the mounting part has a fork-shaped connection portion having upper and lower arms forming an intermediate space therebetween, and the load receiving element has a plate-shaped portion insertable into the intermediate space, the fork-shaped and plate-shaped portions each having a respective bore for the pin.

8. The lifting device according to claim 7, wherein the thickness of the intermediate space is at least no less than the thickness of the load receiving element and a toothing element or blocking element.

9. The lifting device according to claim 1, further comprising a releasable securing element engageable with the pin for securing a work position of the mounting part with respect to the load receiving element.

10. The lifting device according to claim 9, wherein the securing element is formed as a releasable, fastening element, as a circlip or fastening clip which is attachable to or inserted into or onto the pin, or the pin is insertable into the securing element.

11. A lifting device for lifting and lowering vehicles, loads or similar, comprising a support which is movable up and down, a load receiver provided on the support, wherein the load receiver has at least one support or support arm, the support or support arm having a load receiving element, the load receiving element having a bore, a mounting part having a bore, a pin receivable in the bore in the load receiving element and the bore in the mounting part for forming a jointed connection between the load receiving element and the mounting part, and a releasable securing element engageable with the pin for securing a work position of the mounting part with respect to the load receiving element, wherein the load receiving element has at least one abutment surface fixed in relation thereto, and the mounting part has at least one abutment surface fixed in relation thereto that is configured to interfere with the at least one abutment surface of the load receiving element to preclude rotation of the mounting element relative to the load receiving element at either one of at least two relatively rotated positions when the pin is received in the bore in the load receiving element and the bore in the mounting part to form the jointed connection, wherein the securing element is formed as a releasable, fastening element, as a circlip or fastening clip which is attachable to or inserted into or onto the pin, or the pin is insertable into the sercuring element, and wherein the securing element is provided as a spacer element to secure the mounting part in the work position after a partial removal or lifting of the pin.

12. The lifting device according to claim 1, wherein the pin is insertable into the bores after the positioning of the mounting part with respect to the load receiving element.

13. The lifting device according to claim 6, wherein the front surfaces are aligned in a parallel plane as well as radially relative to a longitudinal axis of the bores.

14. The lifting device according to claim 10, wherein the securing element is arranged between the plate-shaped load receiving element and the connection piece.

15. A lifting device for lifting and lowering vehicles, loads or similar having a support which is movable up and down, on which a load receiving means is provided, wherein the load receiving means has at least one support or support arm, wherein a jointed connection is formed between the support or the support arm and a mounting part, in the case of which a positive locking of the mounting part with respect to the support or support arm is formed to maintain the angular position after the alignment of the mounting part with respect to the support or support arm in an angular position with respect to each other and a subsequent positioning of a respective longitudinal axis of at least one bore on the support or support arm with a longitudinal axis of at least one bore on the mounting part, and the support or the support arm and the mounting part are fixed with respect to each other by a cotter pin which is insertable into the bores, or in the case of which, after a positioning of a respective longitudinal axis of at least one bore of the support or of the support arm and of a longitudinal axis of at least one bore with respect to the mounting part with respect to each other, these are mounted rotatably with respect to each other by inserting a cotter pin and the mounting part and the support or the support arm are traversable relative to each other along this longitudinal axis, wherein the mounting part is freely pivotable with respect to the support or the support arm in an adjustment position and a positive locking is formed in a working position after an axial traversing movement between the mounting part and the support or support arm, due to which the adjusted angular position of the mounting part is fixed with respect to the support or support arm, wherein, due to a releasable securing element which strikes the cotter pin, the work position of the mounting part with respect to the support or support arm is secured, wherein the securing element is formed as a releasable, in particular attachable, fastening element, as a circlip or fastening clip which is attachable to or inserted into the cotter pin, or the cotter pin is insertable into the securing element and is preferably arranged between the plate-shaped load receiving element and the connection piece, and wherein the securing element is provided as a spacer element to secure the positive locking which is released after a partial removal or lifting of the pivot pin.

* * * * *